US005301529A

United States Patent [19]

Paybarah et al.

[11] Patent Number: 5,301,529

[45] Date of Patent: Apr. 12, 1994

[54] COIL WINDING METHOD AND APPARATUS

[75] Inventors: Ali Paybarah; Joseph A. McWilliams, both of Droitwich, United Kingdom

[73] Assignee: Zortech International Limited, United Kingdom

[21] Appl. No.: 968,490

[22] Filed: Oct. 29, 1992

[30] Foreign Application Priority Data

Nov. 2, 1991 [GB] United Kingdom ..... 9123300

[51] Int. Cl.[5] ..... B21F 3/04

[52] U.S. Cl. ..... 72/142; 72/145

[58] Field of Search ..... 72/145, 142, 135, 144, 72/371; 140/124

[56] References Cited

U.S. PATENT DOCUMENTS

| | | | |
|---|---|---|---|
| 1,908,884 | 5/1933 | Burd et al. | 72/145 |
| 2,339,424 | 1/1944 | Poole | 72/145 |
| 2,793,672 | 5/1957 | Duff | 72/145 |
| 2,909,209 | 10/1959 | Ciccone et al. | 72/145 |
| 3,359,768 | 12/1967 | Platt | 72/371 |
| 3,785,409 | 1/1974 | Smith; III | 72/144 |
| 4,208,896 | 6/1980 | Platt | 72/142 |
| 4,302,959 | 12/1981 | Yakoulev et al. | 72/138 |
| 4,569,216 | 2/1986 | Platt | 72/138 |

FOREIGN PATENT DOCUMENTS

| | | |
|---|---|---|
| 2446713 | 4/1976 | Fed. Rep. of Germany . |
| 3744640 | 7/1989 | Fed. Rep. of Germany . |

*Primary Examiner*—Lowell A. Larson
*Assistant Examiner*—Michael J. McKeon
*Attorney, Agent, or Firm*—Ira S. Dorman

[57] ABSTRACT

A close wound coil is formed by a sequence of steps including supplying a wire to be formed into a coil onto a rotating mandrel by means of a guide wheel and urging the wire against the mandrel by means of a pressure wheel so as to form a coil. The formed coil is allowed to free itself from engagement with the mandrel from a point immediately following that at which the wire is urged against the mandrel by the pressure wheel to the end of the mandrel so that the formed coil, although carried by the mandrel, is unrestrained relative to the mandrel.

18 Claims, 3 Drawing Sheets

COIL WINDING METHOD AND APPARATUS

The present invention relates to a method and an apparatus for coil winding, and may be used, for example, for winding close wound helical coils of resistance wire.

BACKGROUND TO THE INVENTION

When winding a close wound coil of wire on a rotating mandrel it is known to form the wire into a coil by first guiding the wire around the mandrel and subsequently applying pressure by a pressure wheel which rotates against the mandrel so as to urge the wire against the mandrel. In order to move the coil of wire thus formed along the mandrel, the pressure wheel is formed with an inclined peripheral surface which urges the coil in the required direction. This known manner of winding a helical coil has the disadvantage of requiring pressure both to form the coil and to cause the coil to advance along the mandrel. This imposes an effective limit on the rotational speed of the mandrel of some 2,000 to 4,000 r.p.m.

OBJECT OF THE INVENTION

It is an object of the present invention to provide a method and an apparatus for coil winding which is able to operate at higher rotational speeds.

SUMMARY OF THE INVENTION

According to one aspect of the present invention there is provided a method for winding a close wound coil, which method comprises the steps of:

supplying a wire to be formed into a coil onto a rotating mandrel by means of a guide wheel;

urging the wire against the mandrel by means of a pressure wheel; and allowing the formed coil, from a point immediately following that at which the wire is urged against the mandrel by the pressure wheel to the end of the mandrel, to free itself from engagement with the mandrel.

The circumferential positions of the guide wheel and the pressure wheel about the mandrel may be such as to maximise as far as possible the circumferential distance between the point at which the wire is urged against the mandrel and a point on the circumference of the mandrel at which the wire forming an initial portion of the free formed coil is diverted by the incoming wire supplied to the mandrel and such as to minimise as far as possible the distance between the point at which the incoming wire contacts the mandrel and the point at which the wire is urged against the mandrel by the pressure wheel. Thus, the relationship minimises the circumferential distance over which the wire is maintained in contact against the mandrel by the guide wheel and the pressure wheel.

The wire may be supplied to the mandrel by way of a peripheral groove formed in the guide wheel.

The wire may be urged against the mandrel by way of a groove formed in the pressure wheel.

According to another aspect of the present invention there is provided an apparatus for winding a close wound coil comprising a rotatable mandrel on which the coil is to be formed, a rotatable guide wheel for supplying wire to the mandrel, the guide wheel incorporating a peripheral groove for receiving the wire, and a rotatable pressure wheel for urging the wire against the mandrel, the pressure wheel incorporating a peripheral groove for receiving the wire, characterised in that immediately subsequent to the wire being urged against the mandrel by the pressure wheel the formed coil is not restrained against the mandrel.

The circumferential positions of the guide wheel and the pressure wheel about the mandrel may be such as to maximise as far as possible the circumferential distance between the point at which the wire is urged against the mandrel and a point around the circumference of the mandrel at which the wire forming an initial portion of the unrestrained formed coil is diverted by the incoming wire supplied to the mandrel by the guide wheel and such as to minimise as far as possible the distance between the point at which the incoming wire contacts the mandrel and the point at which the wire is urged against the mandrel by the pressure wheel.

The width of the peripheral groove in the guide wheel may be substantially the same as the diameter of the wire to be coiled. The depth of the peripheral groove in the guide wheel may be substantially one half to the full diameter of the wire to be coiled. The peripheral groove in the guide wheel may be substantially U-shaped. The guide wheel may be chamfered on that peripheral edge thereof adjacent to the formed coil such that the guide wheel does not engage with the wire of the adjoining turn of the unrestrained formed coil.

The pressure wheel may be made of a plastics material such as high density polyethylene plastics material. The depth of the peripheral groove in the pressure wheel may be substantially half the radius of the wire to be coiled. The peripheral groove in the pressure wheel may be substantially U-shaped. The pressure wheel may be formed with an inclined portion adjacent to the groove thereof such that the pressure wheel does not engage with the wire of the adjoining turn of the unrestrained formed coil. The pressure wheel may be provided with an axially extending undercut portion which is dimensioned so as to be spaced from the unrestrained formed coil. The pressure wheel may be mounted so as to be freely rotatable relative to the mandrel. For a better understanding of the present invention and to show more clearly how it may be carried into effect reference will now be made, by way of example, to the accompanying drawings in which:

DESCRIPTION OF PREFERRED EMBODIMENT

Figure 1:
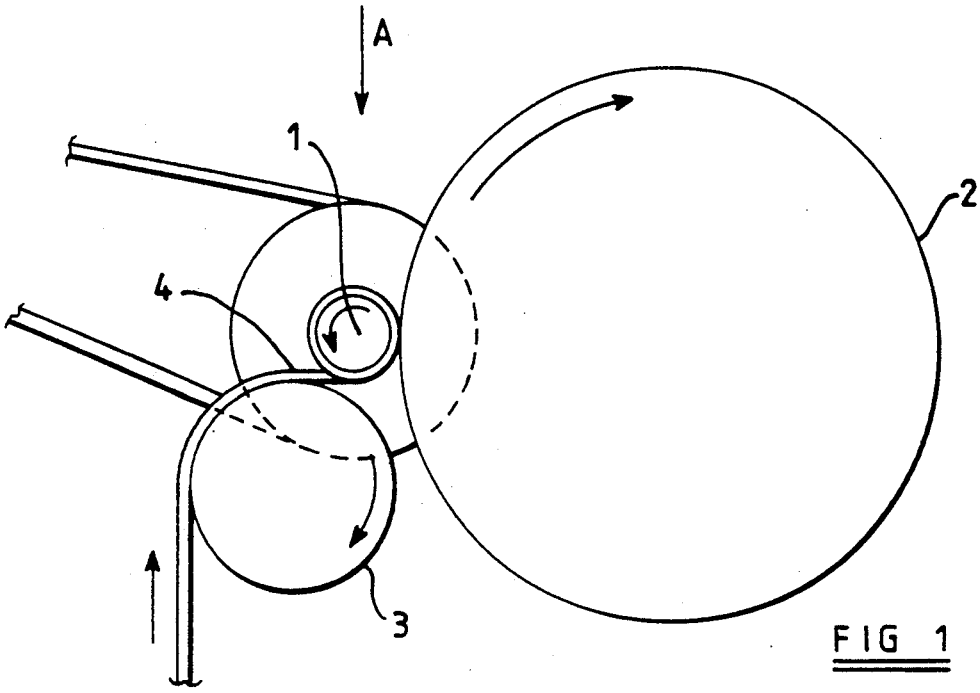
FIG. 1 is an end elevational view, in diagrammatic form, of an apparatus according to the present invention for coil winding.

The figures show an apparatus for winding a close wound coil, the apparatus comprising a mandrel which is rotatable by means well known to the skilled person such as a pulley and belt arrangement as shown diagrammatically in FIG. 1. Mandrel 1 is rotatable at continuously variable speeds, for example up to 10,000 r.p.m. or more. Mounted adjacent to but spaced from the mandrel 1 is a pressure wheel 2 which is mounted so as to be freely rotatable. Also mounted close to but spaced from the mandrel 1 is a freely rotatable guide wheel 3 for feeding wire 4, for example an iron-chromium-aluminium resistance wire having a diameter of some 0.25 to 1 mm, on to the mandrel 1. The mandrel 1 and the guide wheel 3 may be made, for example, of metal or cermet, while the pressure wheel 2 may be made, for example, of relatively hard plastics material, such as high density polyethylene. As can be seen from FIG. 1, the pressure wheel and the guide wheel are arranged such that the wire 4 is in contact with the mandrel 1, and therefore under strain as a result of bending forces applied to the wire, for a minimum angular or circumferential distance prior to being urged against the mandrel by the pressure wheel. In the illustrated embodiment, for a mandrel having a diameter of the order of 3 to 6 mm, a pressure wheel having a diameter of 50 to 150 mm and a guide wheel having a diameter of 50 to 150 mm, the guide wheel is preferably spaced from the mandrel by a distance only sufficient to allow for the diameter of the wire and the spring back that occurs in the coil as it frees itself from the mandrel. The coil is thus formed from the point at which the wire 4 contacts the mandrel 1 to the point at which the pressure wheel 2 urges the wire against the mandrel, that is over an angle of some 90° in the illustrated embodiment. The process of forming a close wound helical coil is shown in more detail in FIG. 2, with the guide wheel being shown in FIGS. 2 and 3 and the pressure wheel being shown in FIGS. 2 and 4. The guide wheel 3 is positioned to feed wire to the mandrel 1 in a direction substantially perpendicular to the axis of the mandrel and is provided with a generally U-shaped peripheral groove 5 which is dimensioned so as to have a width marginally greater than the diameter of the wire and a depth between one half and the full diameter of the wire. The depth of the groove 5 should not be too great as to increase the spacing between the mandrel and the guide wheel unnecessarily, and should not be too shallow as to be insufficient to ensure that the wire remains seated within the groove. The guide wheel 3 is also provided with a chamfered edge 6 on that face of the guide wheel that is adjacent to the formed coil. The amount of the chamfer can readily be determined by the skilled person and is such that the guide wheel does not engage with the wire of the adjoining turn of the coil where the coil has moved out of contact with the mandrel 1.

Figure 4:
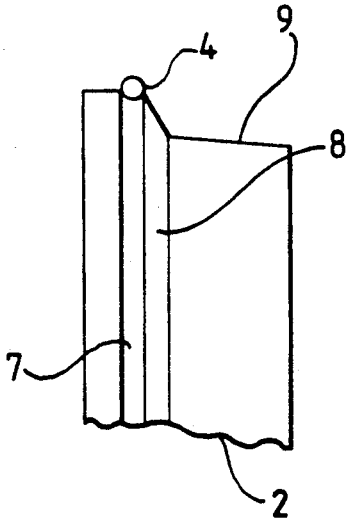
FIG. 4 is a view of the peripheral portion of a pressure wheel shown in FIGS. 1 and 2.

The pressure wheel 2 is arranged in a plane substantially perpendicular to the axial direction of the mandrel 1 and is also provided with a peripheral groove 7. The width of the groove is not as important as with the guide wheel because the pressure wheel is made of a plastics material that is able to adapt itself to the dimensions of the wire. The depth of the groove 7 is of the order of half the radius of the wire to ensure that the wire protrudes sufficiently from the groove 7 so as to be urged against the mandrel 1 without the pressure wheel contacting the mandrel. The groove 7 is generally symmetrical in cross section so as to urge the wire 4 against the mandrel 1 and not to urge the wire in the axial direction of the mandrel. Adjacent to the peripheral groove 7, and on that side of the groove that is adjacent to the formed coil, is an inclined portion 8, the inclination of which is such that the pressure wheel does not engage with the wire of the adjoining turn of the formed coil. Adjacent to the inclined portion 8 is an undercut portion 9 of the pressure wheel which is dimensioned so as to be spaced from the formed coil 10 taking into account the diameter of the wire 4 and also the spring back that frees the coil from the mandrel. The undercut portion 9 assists in allowing the pressure wheel to be made sufficiently stiff. If desired, as shown in FIG. 4, the undercut portion 9 of the pressure wheel may be formed at an acute angle relative to the axial direction of the mandrel.

Figure 2:
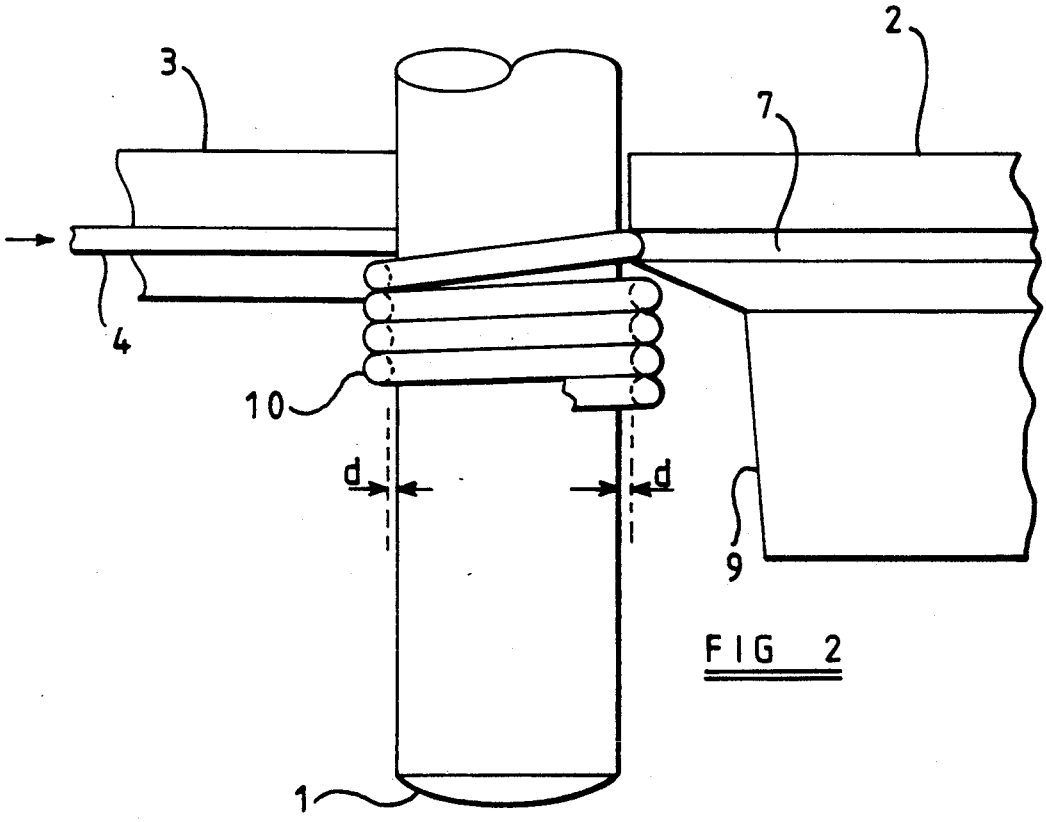
FIG. 2 is a view looking in the direction of the arrow A in FIG. 1, on a different scale to FIG. 1.
Figure 3:
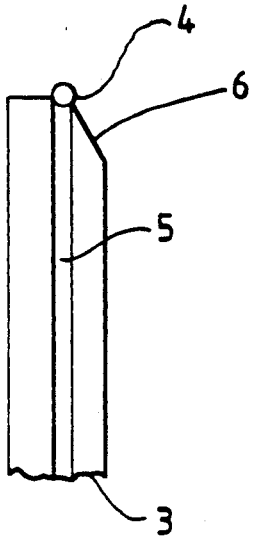
FIG. 3 is a view of the peripheral portion of a guide wheel shown in FIGS. 1 and 2.
Figure 5:
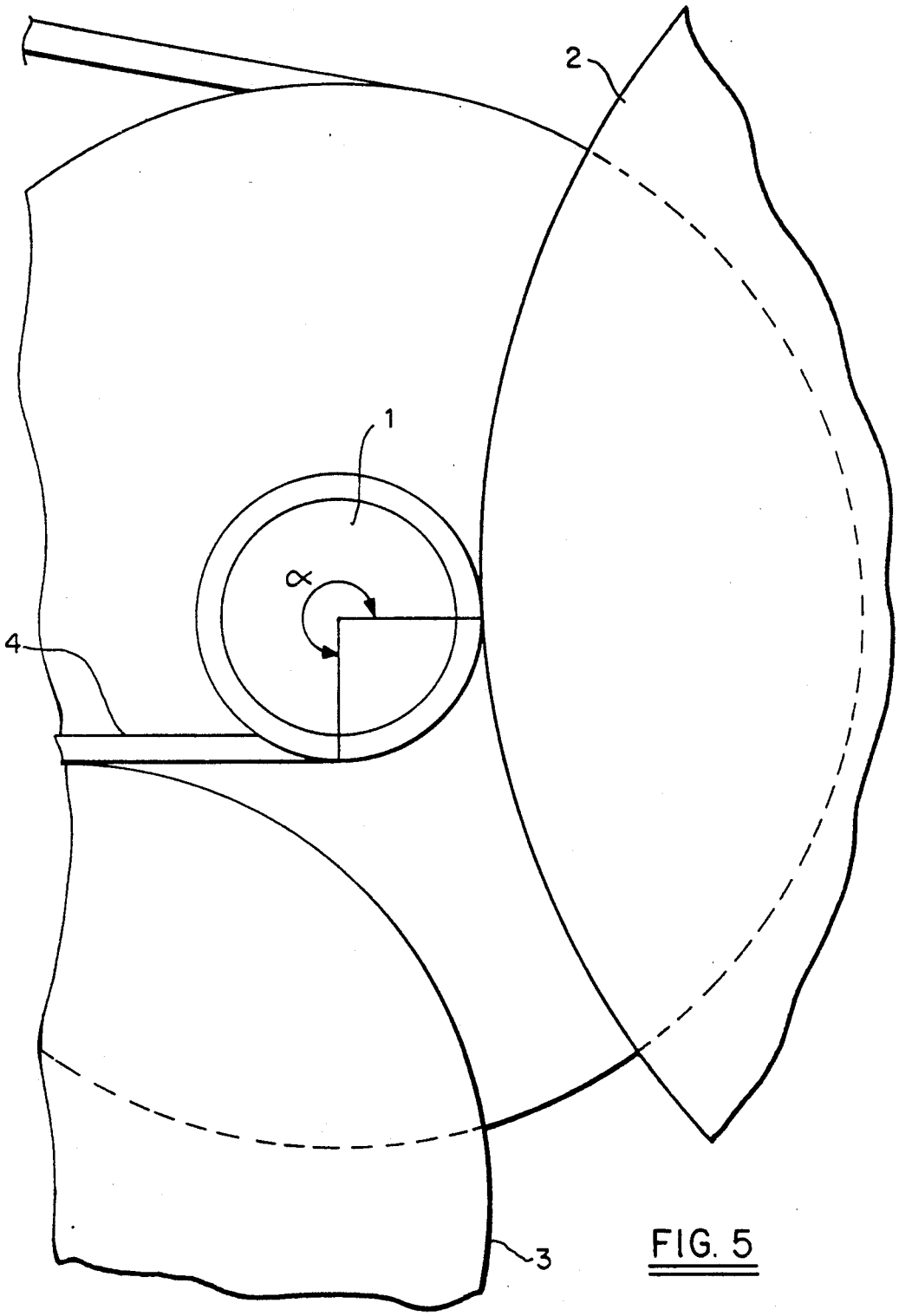
FIG. 5 shows a portion of the apparatus of FIG. 1, drawn in an enlarged scale.

In use, the forming action on the wire is performed in that region from the initial point of contact with the mandrel 1 to the point at which the pressure wheel urges the wire against the mandrel. Immediately thereafter the coil is free to perform its natural spring back which results in the internal diameter of the formed coil increasing by a small amount, but sufficiently for the coil to be freed from the mandrel 1 so as to allow an annular space of radial extent 'd' as shown in FIG. 2 between the outer periphery of the mandrel 1 and the inner circumference of the coil 10. In practice, of course, the space may not be annular but may adopt different configurations. The formed coil is therefore not restrained to bear against the mandrel the pressure wheel 2 and the guide wheel 3 although the formed coil is carried by the mandrel along the length thereof. As subsequent turns of the coil are formed, the portion of the wire under strain, that is from the initial point of contact with the mandrel to the pressure wheel, is able to urge the unrestrained coil along and off the end of the mandrel 1. In particular for heavier wire gauges, for example from 0.7 to 1.0 mm, this is facilitated according to the present invention by maximising the angular or circumferential distance (identified by the angle d in FIG. 5) between the point at which the coil is formed by the pressure wheel and the diversion point of the wire, which is at a similar angular or circumferential position to the initial point of contact between the wire and the mandrel. Thus no specific mechanism is required to urge the formed coil along the mandrel as has hitherto been the case. The method and apparatus according to the invention are able to operate successfully at rotational speeds up to 10,000 r.p.m. or more.

We claim:

1. A method for winding a close wound coil, comprising the steps of:

supplying a wire to be formed into a coil onto a rotating mandrel by means of a guide wheel, the mandrel having a driven end and a free end;

urging the wire against the mandrel at a point between the driven and free ends thereof, by means of a pressure wheel, so as to cause the wire to deform and to become engaged around and in contact with the mandrel; and allowing the formed coil, from a point immediately following that at which the wire is urged against the mandrel by the pressure wheel, to become free from engagement with the mandrel and free from contact with the pressure wheel.

2. A method according to claim 1, wherein the guide wheel is arranged at a first circumferential position around the periphery of the mandrel and the pressure wheel is arranged at a second circumferential position around the periphery of the mandrel, the circumferential positions of the guide wheel and the pressure wheel about the periphery of the mandrel being proximate one another so as to minimise spacing therebetween and in turn minimise the circumferential distance over which the wire is maintained in contact against the mandrel by the guide wheel and the pressure wheel.

3. A method according to claim 1, wherein the wire is supplied to the mandrel by way of a peripheral groove formed in the guide wheel.

4. A method according to claim 1, wherein the wire is urged against the mandrel by way of a groove formed in the pressure wheel.

5. A method for winding a close wound coil, comprising the steps of:

supplying a wire to be formed into a coil onto a rotating mandrel by means of a guide wheel, the mandrel having a driven end and a free end and the guide wheel being arranged to rotate freely relative to the mandrel and being spaced therefrom;

urging the wire against the mandrel at a point between the driven and free ends thereof, by means of a pressure wheel, so as to cause the wire to deform and to become engaged around and in contact with the mandrel; and allowing the formed coil, from a point immediately following that at which the wire is urged against the mandrel by the pressure wheel, to become free from engagement with the mandrel and free from contact with the pressure wheel.

6. Apparatus for winding a close wound coil, comprising:

a rotatable mandrel on which the coil is to be formed, the mandrel having a driven end and a free end;

a rotatable guide wheel for supplying wire to the mandrel, the guide wheel incorporating a peripheral groove for receiving the wire; and a rotatable pressure wheel for urging the wire against the mandrel at a point between the driven and free ends thereof, so as to cause the wire to deform and to become engaged around an in contact with the mandrel, the pressure wheel incorporating a peripheral groove for receiving the wire, the mandrel and pressure wheel being so constructed and disposed that the wire is freed from engagement with the mandrel and freed from contact with the pressure wheel immediately following the point at which it is urged against the mandrel by the pressure wheel.

7. Apparatus as claimed in claim 6, wherein the guide wheel is arranged at a first circumferential position around the periphery of the mandrel and the pressure wheel is arranged at a second circumferential position around the periphery of the mandrel, the circumferential positions of the guide wheel and the pressure wheel being proximate one another so as to minimise spacing therebetween and in turn minimise the circumferential distance over which wire supplied to the mandrel from the guide wheel is maintained in contact against the mandrel by the guide wheel and the pressure wheel.

8. Apparatus as claimed in claim 6, wherein the peripheral groove in the guide wheel has a width substantially the same as the diameter of the wire to be coiled.

9. Apparatus as claimed in claim 6, wherein the peripheral groove in the guide wheel has a depth substantially one half to the full diameter of the wire to be coiled.

10. Apparatus as claimed in claim 6, wherein the peripheral groove in the guide wheel is substantially U-shaped.

11. Apparatus as claimed in claim 6, wherein the guide wheel is chamfered on that peripheral edge thereof adjacent to the formed coil such that the guide wheel does not engage with the wire of the adjoining turn of the formed coil.

12. Apparatus as claimed in claim 6, wherein the pressure wheel is made of a plastics material such as high density polyethylene plastics material.

13. Apparatus as claimed in claim 6, wherein the peripheral groove in the pressure wheel has a depth substantially half the radius of the wire to be coiled.

14. Apparatus as claimed in claim 6, wherein the peripheral groove in the pressure wheel is substantially U-shaped.

15. Apparatus as claimed in claim 6, wherein the pressure wheel is formed with an inclined portion adjacent to the groove thereof such that the pressure wheel does not engage with the wire of the adjoining turn of the formed coil.

16. Apparatus as claimed in claim 6, wherein the pressure wheel is provided with an axially extending undercut portion which is dimensioned so as to be spaced from the formed coil.

17. Apparatus as claimed in claim 6, wherein the pressure wheel is mounted so as to be freely rotatable relative to the mandrel.

18. Apparatus for winding a close wound coil, comprising:

a rotatable mandrel on which the coil is to be formed, the mandrel having a driven end and a free end;

a rotatable guide wheel for supplying wire to the mandrel, the guide wheel being arranged to rotate freely relative to the mandrel and being spaced therefrom, the guide wheel incorporating a peripheral groove for receiving the wire; and a rotatable pressure wheel for urging the wire against the mandrel at a point between the driven and free ends thereof, so as to cause the wire to deform and to become engaged around and in contact with the mandrel, the pressure wheel incorporating a peripheral groove for receiving the wire, the mandrel and pressure wheel being so constructed and disposed that the wire is freed from engagement with the mandrel and freed from contact with the pressure wheel immediately following the point at which it is urged against the mandrel by the pressure wheel.

* * * * *